US006532984B2

(12) United States Patent
Liu

(10) Patent No.: US 6,532,984 B2
(45) Date of Patent: Mar. 18, 2003

(54) CONSTANT FLOW LIQUID SUPPLIER

(76) Inventor: Chung-Kun Liu, No. 25, Ching-Chern 10th St., Taichung (TW)

( * ) Notice: Subject to any disclaimer, the term of this patent is extended or adjusted under 35 U.S.C. 154(b) by 0 days.

(21) Appl. No.: 09/996,743

(22) Filed: Nov. 30, 2001

(65) Prior Publication Data

US 2002/0092561 A1 Jul. 18, 2002

(30) Foreign Application Priority Data

Jan. 17, 2001 (TW) ..... 90100992 A

(51) Int. Cl.[7] ..... F04F 10/00

(52) U.S. Cl. ..... 137/135; 137/150.5; 137/152; 137/391

(58) Field of Search ..... 137/135, 150.5, 137/152, 391; 222/416

(56) References Cited

FOREIGN PATENT DOCUMENTS

SU 436983 * 7/1974 ..... 222/416

* cited by examiner

*Primary Examiner*—Gerald A. Michalsky
(74) *Attorney, Agent, or Firm*—Rosenberg, Klein & Lee

(57) ABSTRACT

A constant flow liquid supplier includes a body having a cavity defined to contain liquid. An inlet assembly floats on the liquid surface and selectively opens the inlet of the constant flow liquid supplier. An outlet assembly floats on the liquid surface and has an inverted U-shaped siphon. The siphon has an inlet in the cavity and an outlet out of the body. The outlet is lower than the inlet. According to the principles of operation of a siphon and the structure of the present invention, the liquid in the body will flow out of the outlet of the siphon at a constant rate until the siphon shuts off.

9 Claims, 5 Drawing Sheets

CONSTANT FLOW LIQUID SUPPLIER

BACKGROUND OF THE INVENTION

1. Field of the Invention

The present invention relates to a liquid supplier, and more particularly to a constant flow device that supplies a constant flow of a liquid.

2. Description of Related Art

With reference to FIG. 5, a conventional constant flow liquid supplier in accordance with the prior art comprises a tank (90) and an adjustable control unit (94). The tank (90) including a supply tube (91) and a discharge tube (92) mounted near the bottom of the tank (90). A remotely operated valve (not numbered) is mounted in the supply tube (91) to selectively open the supply tube (91). A discharge valve (not numbered) is mounted in the outlet tube (92) to control the liquid discharged. The adjustable control unit (94) is electrically connected to the remotely operated valve and has a float ball (93) floating on the surface of the liquid in the tank (90). The float ball (93) is connected to the control unit (94) by a wire (not numbered) so that the float ball (93) pulls the control unit (94) when the surface of the liquid drops to a suitable level. The force transmitted to the control unit (94) is transformed to a signal to the remotely controlled valve to open the supply tube (91)

However, the conventional constant flow liquid supplier has the following disadvantages that need to be improved.

1. Complex and high cost: The remotely controlled valve, the discharge valve and the control unit (94) are necessary elements of the conventional constant flow liquid supplier so that the structure of the conventional constant flow liquid supplier is complex and has a high cost.

2. Unstable and not precise: The instantaneous discharge of the conventional liquid supplier varies depending on the liquid level because a high pressure is applied to the discharge valve when the liquid surface is high in the tank (90) and a lower pressure is applied when the liquid surface comes down. The pressure of the liquid in the tank will impact the preciseness of the discharge valve.

3. Waste power: Electricity is necessary to the control unit (94) so that the conventional constant flow liquid supplier cannot operate when the electric power is interrupted.

4. Easily fail: The conventional constant flow liquid supplier does not work when any one of the remotely controlled valve, the discharge valve or the control unit (94) is broken.

The present invention has arisen to mitigate and/or obviate the disadvantages of the conventional constant flow liquid supplier.

SUMMARY OF THE INVENTION

The main objective of the present invention is to provide an improved constant flow liquid supplier that uses a floating siphon to control the discharge.

To achieve the objective, the constant flow liquid supplier in accordance with the present invention comprises a body having a cavity defined to contain liquid. An inlet assembly floats on the liquid surface and selectively opens the inlet of the constant flow liquid supplier. An outlet assembly floats on the liquid surface and has an inverted U-shaped siphon. The siphon has an inlet in the cavity and an outlet out of the body. The outlet is lower than the inlet. Based on the principles of operation of a siphon and the structure of the present invention, the liquid in the body flows out of the outlet of the siphon at a constant rate when the siphon is discharging liquid.

Further benefits and advantages of the present invention will become apparent after a careful reading of the detailed description with appropriate reference to the accompanying drawings.

DETAILED DESCRIPTION OF THE INVENTION

Figure 1:
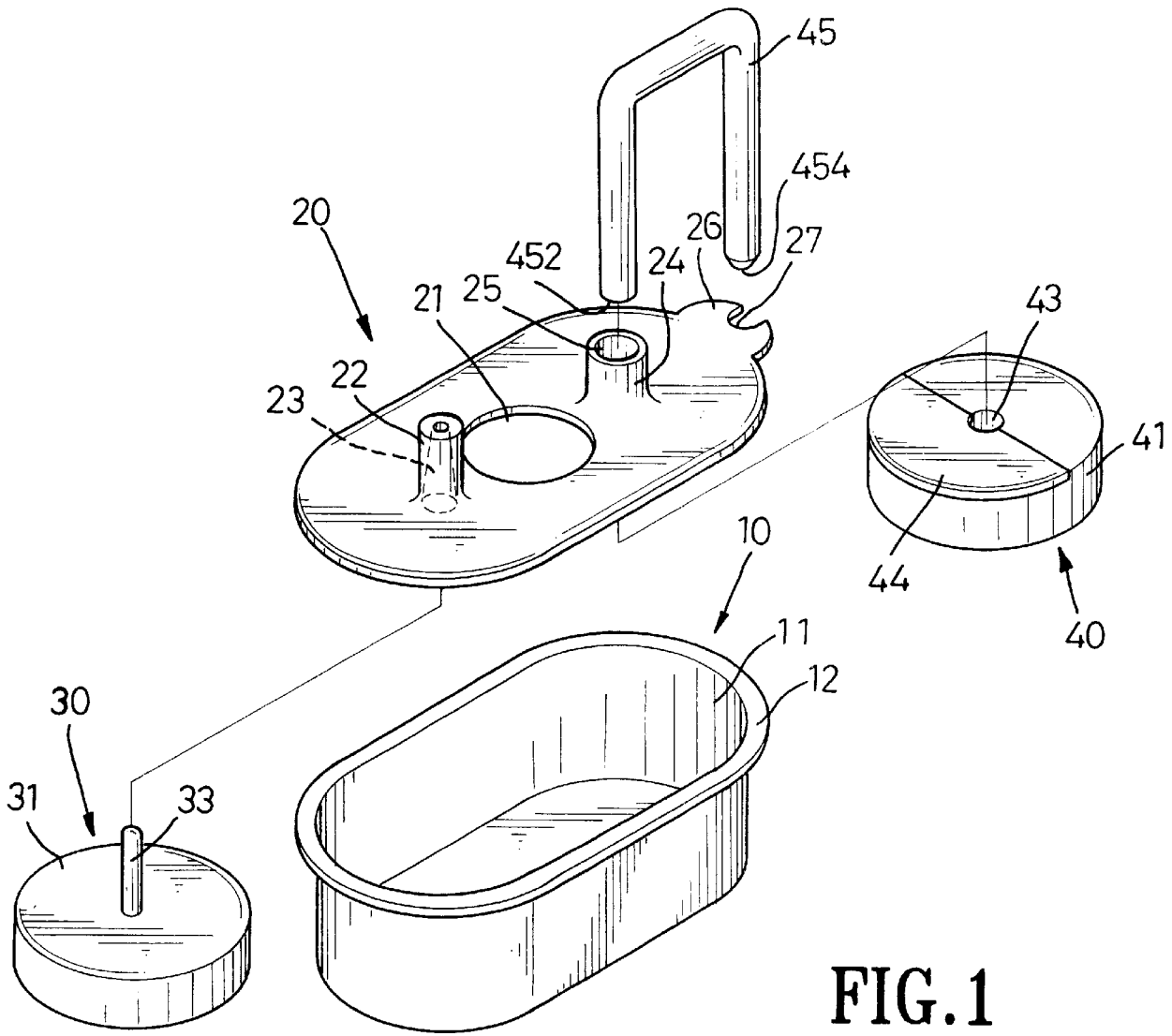
FIG. 1 is an exploded perspective view of a constant flow liquid supplier in accordance with the present invention.
Figure 2:
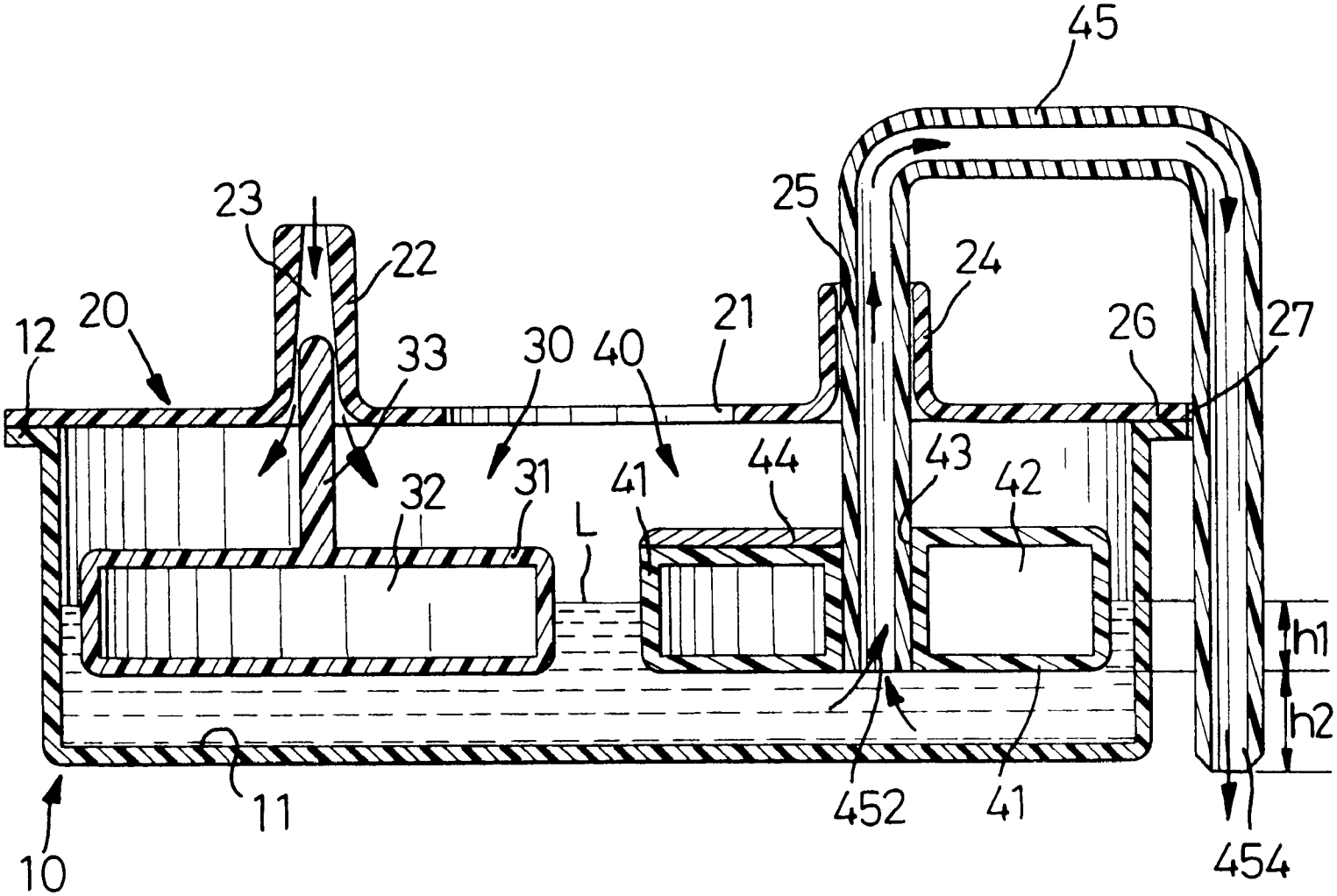
FIG. 2 is a cross sectional side plan view of the constant flow liquid supplier in FIG. 1 when the liquid surface is at a normal level.

With reference to the drawings and initially to FIGS. 1 and 2, a constant flow liquid supplier in accordance with the present invention comprises a body (10), a cover (20), an inlet assembly (30) and an outlet assembly (40). The cover (20) is attached to the body (10). The inlet assembly (30) floats in the hollow body (10). The outlet assembly (40) floats in the hollow body (10) and has a siphon (45) partially extending through the cover (20).

The hollow body (10) includes a cavity (11) defined to contain liquid and a lip (12) laterally extending outwardly from the top of the body (10).

The cover (20) is securely attached to the lip (12) of the hollow body (10) to close the cavity (11) in the body (10). An opening (21) is centrally defined in the cover (20). An inlet nipple (22) and a sleeve (24) extend perpendicular upward from the cover (20) on diametrically opposite sides of the opening (21). The inlet nipple (22) is adapted to be connected to a liquid source and has an inlet passage (23) defined through the inlet nipple (22) to communicate with cavity (11) in the body (10). The inlet passage (23) is conical and has a diameter gradually decreasing from the bottom to the top of inlet passage (23). A through hole (25) is axially defined through the sleeve (24) and communicates with the cavity (11) in the body (10). The cover (20) includes a tab (26) laterally extending from the edge of the cover (20) near the sleeve (24) and a notch (27) defined in the tab (26).

The inlet assembly (30) comprises a first floating member (31) corresponding to the inlet nipple (22) and an air tank (32) formed in the first floating member (31) to make the first floating member (31) float on the liquid surface. A rod (33) centrally extends perpendicular from the top of the first floating member (31). The free end of the rod (33) has a diameter equal to that of the middle portion of the inlet passage (23) so that the rod (33) can selectively close the inlet passage (23) when the liquid surface is raised. Further with reference to FIG. 4, the rod (33) is partially received in the inlet passage (23) when the liquid surface is at the lowest level.

The outlet assembly (40) comprises a second floating member (41) in the shape of a ring to centrally define a through hole (43) and an air tank (42) formed in the second floating member (41). The through hole (43) in the second floating member (41) corresponds to the through hole (25) in the sleeve (24) and has a diameter lightly smaller than that of the through hole (25) in the sleeve (24). An inverted U-shaped siphon (45) includes a first end forming an inlet (452) and a second end forming an outlet (454). The first end of the siphon (45) is inserted into the body (10) through the through hole (25) in the sleeve (24) and secured in the through hole (43) in the second floating member (41) with a compression fit. The outlet (454) of the siphon (45) is lower than the inlet (452) of the siphon (45). The siphon (45) has a diameter slightly smaller than that of the through hole (25) in the sleeve (24) and the notch (27) in the tab (26) so the siphon (45) and the second floating member (41) are free to move vertically. The inverted U-shaped siphon (45) has two vertical sections respectively and movably received in the through hole (25) in the sleeve (24) and the notch (27) in the tab (26). A counterweight (44) is attached to the second floating member (41) to counter the off-center weight of the siphon (45) and align the center of with the center of the second floating member (41).

With reference to FIG. 2, liquid flows into the cavity (11) in the body (10) through the inlet passage (23) in the inlet nipple (22). With the liquid surface at a normal level (L), the inlet assembly (30) and the outlet assembly (40) float on the liquid surface. A first difference of level (hi) is formed between the inlet (452) of the siphon (45) and the normal level (L). A second difference of level (h2) is formed between the inlet (452) of the siphon (45) and the outlet (454) of the siphon (45). The first difference of level (h1) and the second difference of level (h2) are set so that the total difference of level (h1+h2) of the present invention is set. A sucker (not shown) is provided to make the liquid full fill the siphon (45) when the present invention is used in a first time and removed after the liquid flowing out of the siphon (45). Consequently, when liquid fills the siphon (45) and begins to flow out of the outlet (454), the principle governing the operation of a siphon cause the liquid in the cavity (11) in the body (10) to continue to flow out of the outlet (454) of the siphon (45) at a constant rate.

Figure 3:
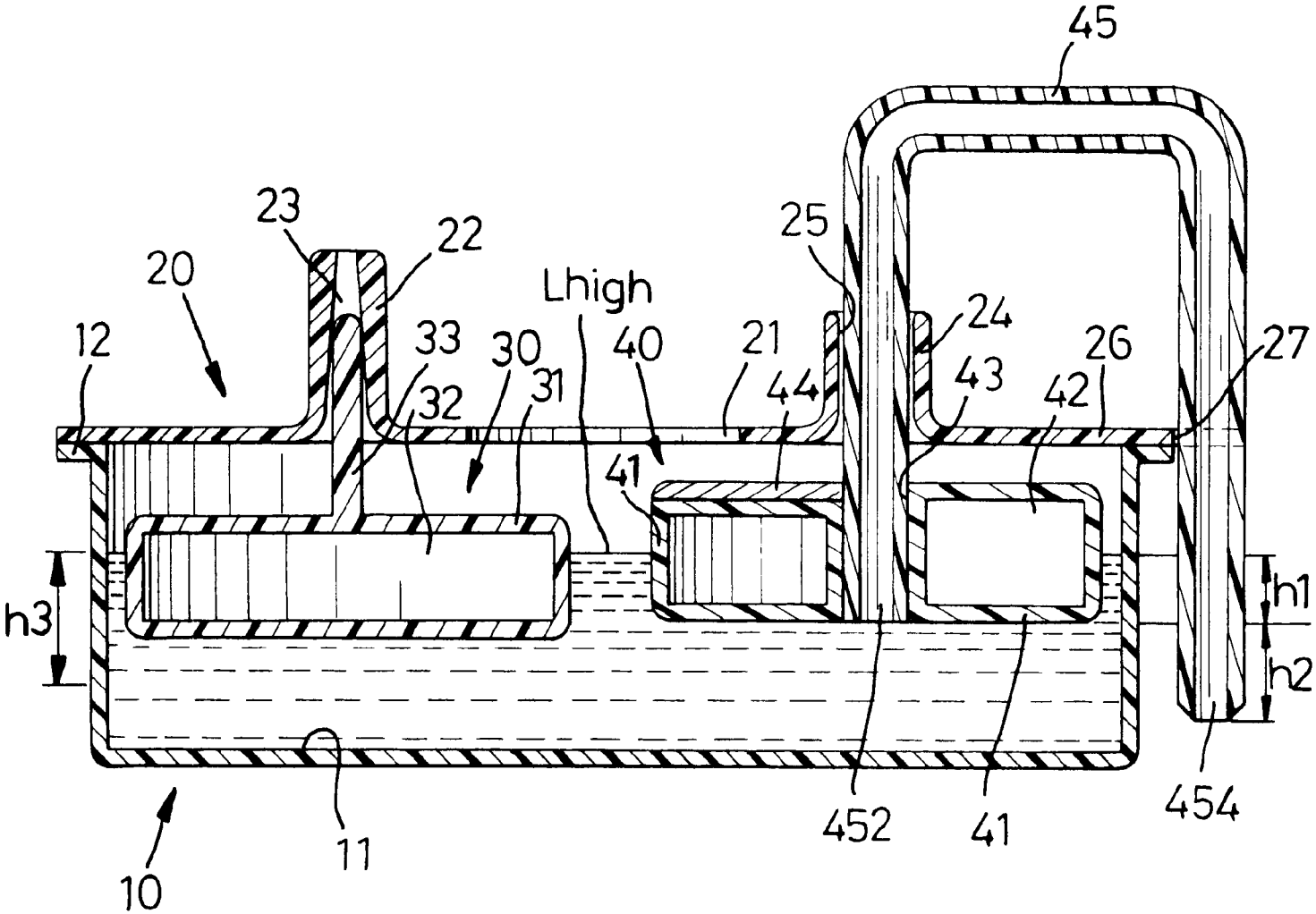
FIG. 3 is a cross sectional side plan view of the constant flow liquid supplier in FIG. 1 when the liquid surface is at a highest level.

With reference to FIGS. 2 and 3, the liquid flows into the cavity (11) and the liquid level rises to a highest level (L high). The rod (33) on the first floating member (31) moves upward into the inlet passage (23) and shuts off the flow of liquid into the cavity (11) because the inlet passage (23) is conical. As described above, the liquid in the cavity (11) continually flows out of the outlet (454) and the liquid source continually provides liquid into the cavity (11) until the siphon effect is broken when the liquid surface is under the highest level (L high).

Figure 4:
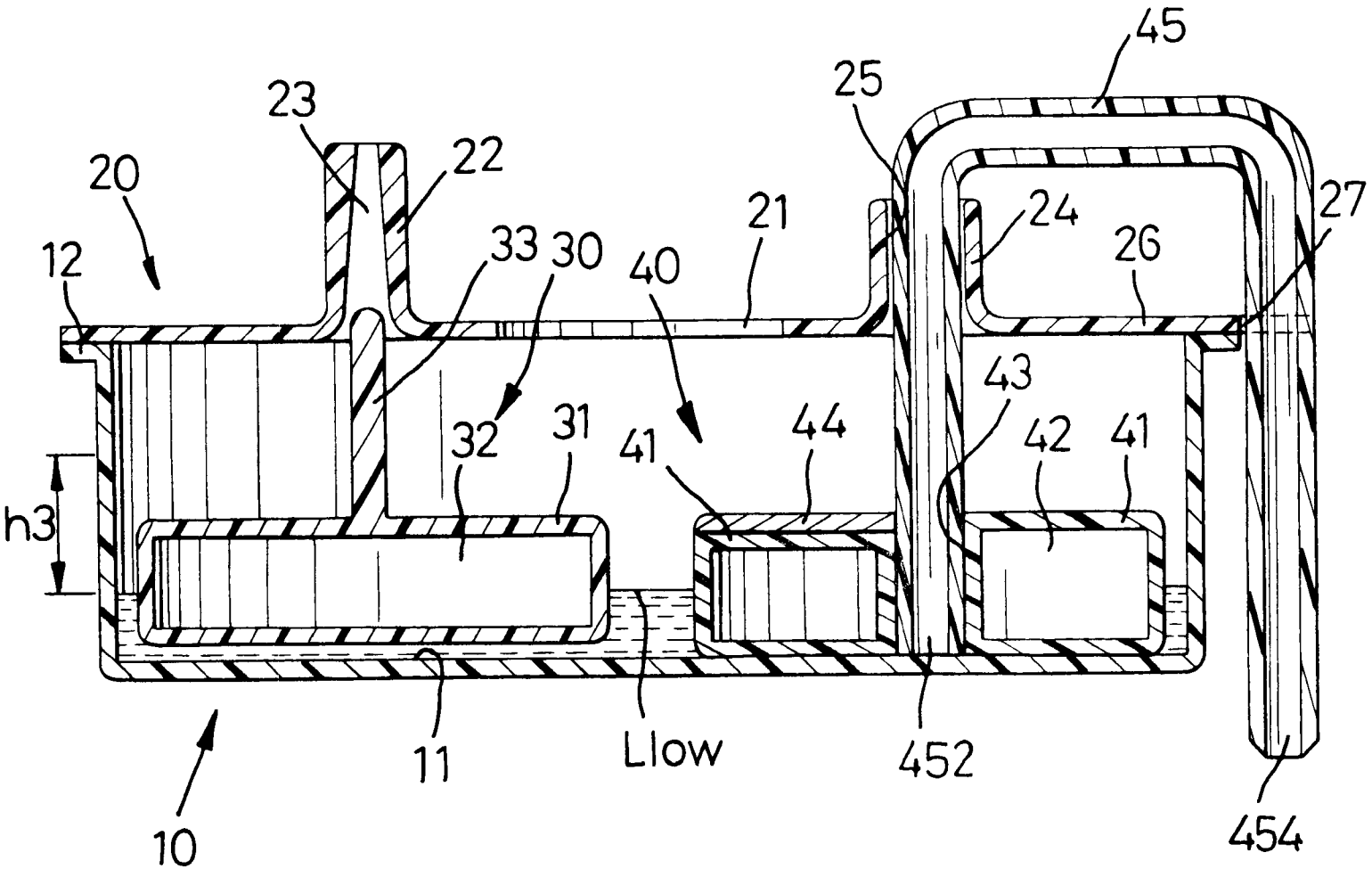
FIG. 4 is a cross sectional side plan view of the constant flow liquid supplier in FIG. 1 when the liquid surface is at a lowest level.
Figure 5:
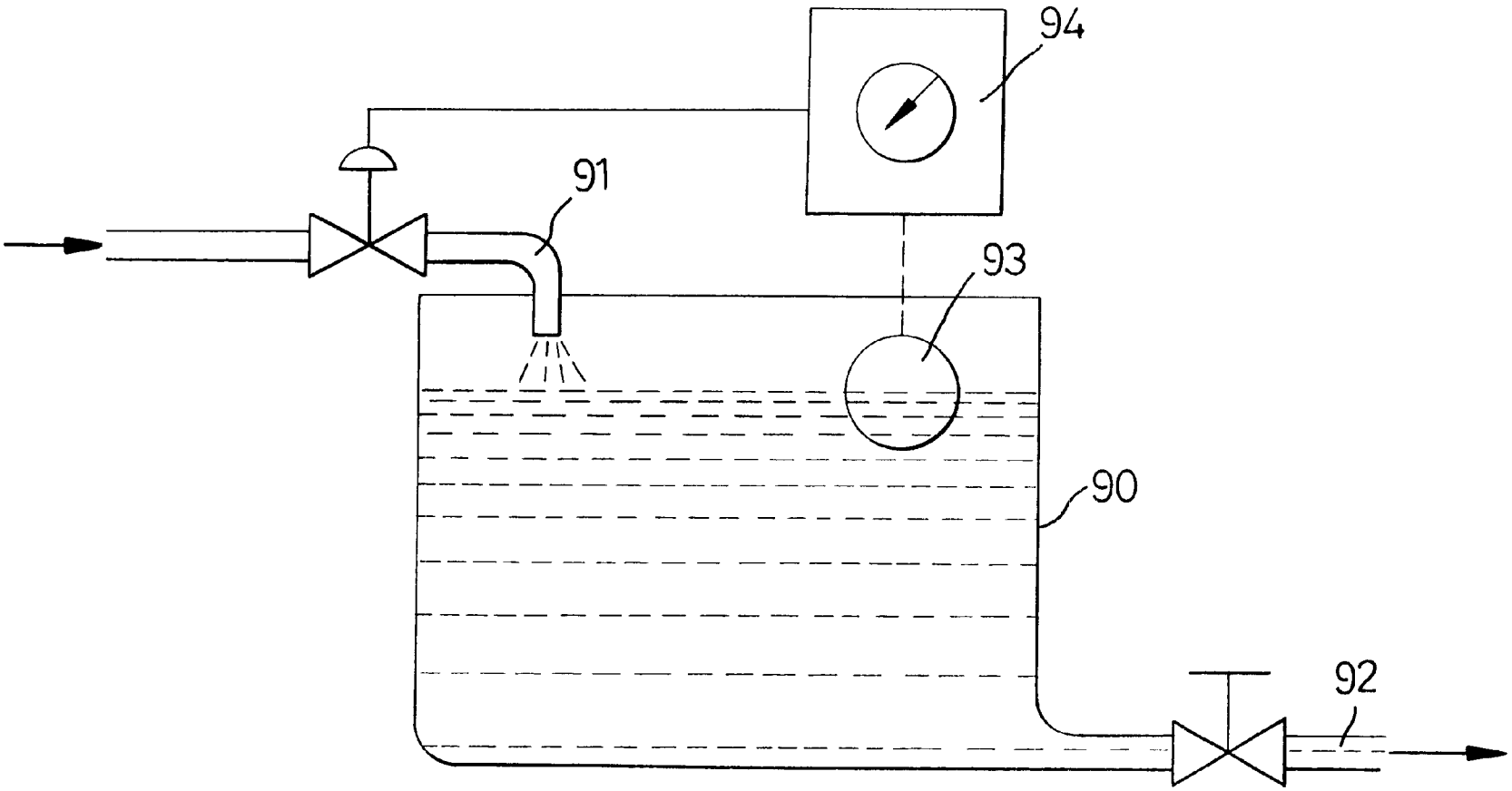
FIG.5 PRIOR ART
FIG. 5 is a side plan view of a conventional constant flow liquid supplier in accordance with the prior art.

With reference to FIG. 4, the inlet (23) is opened when the liquid surface goes down, and liquid flows into the cavity (11) of the body (10). The second floating member (41) hits the bottom of the cavity (11) in the body (10), when the liquid in the cavity (11) is exhausted. The liquid in the siphon (45) does not flow out from the siphon (45) because the inlet (452) of the siphon (45) is closed by the bottom of the cavity (11) so that the constant flow liquid supplier automatically supplies liquid when the liquid flows into the cavity (11) again, and the second floating member (41) floats up relative to the bottom of the cavity (11).

The constant flow liquid supplier in accordance with the present invention has the following advantages.

1. Precise: The total difference of level (h1+h2) of the present invention is certainly set so that the discharge of the present invention is certain and can be provide to a precise use.

2. Simple and low cost: The structure of the present invention is simple and easily assembled so that the manufacturing cost is reduced.

3. Safety: Liquids are good conductor of electricity, and the conventional constant flow liquid supplier uses liquids and electricity in the same environment so the device is a potential electrical hazard. Since no electricity is used with the present invention, this problem never arises.

4. Free failure: The power of the present invention is atmospheric pressure that provides the constant function of the present invention. Consequently, the system effect of the constant flow liquid supplier in accordance with the present invention is steady and never broken unless a human action.

5. Free energy: No electricity is necessary. The siphon provides all necessary power so no external energy source is used.

Although the invention has been explained in relation to its preferred embodiment, it is to be understood that many other possible modifications and variations can be made without departing from the spirit and scope of the invention as hereinafter claimed.

What is claimed is:

1. A constant flow liquid supplier comprising:

a body including a cavity defined and adapted to contain liquid;

a cover attached to a top of the body to close the cavity, the cover including:

an opening centrally defined in the cover;

an inlet nipple and a sleeve respectively extending perpendicular upward from the cover, the inlet nipple adapted to be connected to a liquid source and the sleeve having a through hole defined to communicate with the cavity; and an outlet assembly partially received in the cavity in the body, the outlet assembly including:

a floating member including a through hole centrally defined in the floating member and an air tank formed in the floating member so that the floating member is adapted to float on a liquid surface due to the air tank; and an inverted U-shaped siphon including a first end forming an inlet and a second end forming an outlet, the first end of the inverted U-shaped siphon inserted into the body through the through hole in the sleeve and secured in the through hole in the floating member of the outlet assembly, the outlet of the inverted U-shaped siphon being lower than that of the inlet of the inverted U-shaped siphon relative to the liquid surface, the inverted U-shaped siphon having a diameter lightly smaller than that of the through hole in the sleeve so that a vertical section of the inverted U-shaped siphon is movably received in the through hole in the sleeve.

2. The constant flow liquid supplier as claimed in claim 1, wherein the inlet nipple comprises an inlet passage defined to communicate with the cavity in the body, the inlet passage being conical and having a diameter gradually decreasing from a bottom to a top of the inlet passage.

3. The constant flow liquid supplier as claimed in claim 2 further comprising an inlet assembly received in the cavity in the body, the inlet assembly including:

a floating member corresponding to the inlet nipple;

an air tank formed in the floating member of the inlet assembly so that the floating member of the inlet assembly is adapted to float on a liquid surface due to the air tank of the floating member of the inlet assembly; and a rod centrally and perpendicularly extending upward from the floating member of the inlet assembly, the rod having a diameter equal to that of a middle portion of the inlet passage so that the rod selectively closes the inlet passage when the floating member of the inlet assembly floats upward due to the liquid in the cavity and the rod is partially received in the inlet passage when the floating member of the inlet assembly hits a bottom of the cavity.

4. The constant flow liquid supplier as claimed in claim 3, wherein the outlet assembly comprises a counterweight attached to the floating member of the outlet assembly to make a center of gravity of the siphon align with the center of the floating member of the outlet member.

5. The constant flow liquid supplier as claimed in claim 4, wherein the cover comprises an tab laterally extending from an edge of the cover, the tab having a notch defined to have a diameter lightly greater than that of the inverted U-shaped siphon and movably received the inverted U-shaped siphon in the notch in the tab.

6. The constant flow liquid supplier as claimed in claim 5, wherein the body comprises a lip laterally extending outwardly from the top of the body and the cover is attached to the body on the lip.

7. The constant flow liquid supplier as claimed in claim 1, wherein the outlet assembly comprises a counterweight attached to the floating member of the outlet assembly to make a center of gravity of the siphon align with the center of the floating member of the outlet member.

8. The constant flow liquid supplier as claimed in claim 7, wherein the cover comprises an tab laterally extending from an edge of the cover, the tab having a notch defined to have a diameter lightly greater than that of the inverted U-shaped siphon and movably received the inverted U-shaped siphon in the notch in the tab.

9. The constant flow liquid supplier as claimed in claim 8, wherein the body comprises a lip laterally extending outwardly from the top of the body and the cover is attached to the body on the lip.

* * * * *